US005443651A

United States Patent [19]

Kalota et al.

[11] Patent Number: 5,443,651

[45] Date of Patent: Aug. 22, 1995

[54] PROCESS FOR METAL CLEANING

[75] Inventors: Dennis J. Kalota, Fenton; David C. Silverman, Chesterfield, both of Mo.

[73] Assignee: Monsanto Company, St. Louis, Mo.

[21] Appl. No.: 212,450

[22] Filed: Mar. 11, 1994

Related U.S. Application Data

[63] Continuation-in-part of Ser. No. 92,932, Jul. 19, 1993, which is a continuation-in-part of Ser. No. 475,506, Feb. 6, 1990, abandoned.

[51] Int. Cl.[6] ..... C23G 1/02

[52] U.S. Cl. ..... 134/2; 134/41

[58] Field of Search ..... 134/2, 41; 252/82, 180, 252/392

[56] References Cited

U.S. PATENT DOCUMENTS

| | | | |
|---|---|---|---|
| 3,764,545 | 10/1973 | Aguadiach et al. | 252/171 |
| 3,846,380 | 11/1974 | Fujimoto | 525/328.2 |
| 3,847,663 | 11/1974 | Shumaker | 134/2 |
| 4,333,844 | 6/1982 | Duggleby et al. | 252/97 |
| 4,363,797 | 12/1982 | Jacquet et al. | 424/70 |
| 4,407,722 | 10/1983 | Davies et al. | 252/91 |
| 4,428,749 | 1/1984 | Morris | 8/137 |
| 4,470,920 | 9/1984 | Leveskis | 252/142 |
| 4,532,065 | 7/1985 | Cohen et al. | 252/135 |
| 4,839,461 | 6/1989 | Boehmke | 252/80 |
| 4,971,724 | 11/1990 | Kalota et al. | 252/390 |
| 5,015,298 | 5/1991 | Arrington | 134/2 |
| 5,057,597 | 10/1991 | Koskan | 528/328 |
| 5,116,513 | 5/1992 | Koskan et al. | 252/180 |
| 5,152,902 | 10/1992 | Koskan et al. | 252/180 |
| 5,219,986 | 6/1993 | Cassata | 530/324 |
| 5,221,733 | 6/1993 | Koskan et al. | 530/333 |

FOREIGN PATENT DOCUMENTS

14775/92 4/1991 Australia .

OTHER PUBLICATIONS

"Role of Some Biologically Important Compounds on the Corrosion of Mild Steel and Copper in Sodium Chloride Solution", Ramakrishnaiah, *Bulletin of Electrochemistry* vol. 2, pp. 7–10.

"Temperature Effect on the Molecular Weight and the Optical Purity of Anhydropolyaspartic Acid Prepared by Thermal Polycondensation", Kokufuta et al *Bulletin of the Chemical Society of Japan,* vol. 51(5) 1555–1556.

"Water-Soluble Polyamides as Potential Drug Carriers", Neuse et al; *Die Angewandte Makromolekulare Chemie* 192 (1991) 35–50 (Nr 3300).

"The Use of Polymers for Retardation of Scale Formation" NRCD 8–76 150–157 (1977) Sarig et al.

"Chemical Studies of Polyaspartic Acids"; Kovacs et al.

"Corrosion Inhibition by Thermal Polylaspartate", Little et al.

*Primary Examiner*—Gary Geist
*Assistant Examiner*—Valerie Fee
*Attorney, Agent, or Firm*—R. C. Loyer

[57] ABSTRACT

Aqueous compositions comprising certain amino acids such as polyaspartic acid or aspartic acid/glutamic acid copolymers when at least partially protonated at pH of 7 or below effectively clean ferrous metal surfaces by contacting said surfaces with said compositions.

12 Claims, 1 Drawing Sheet

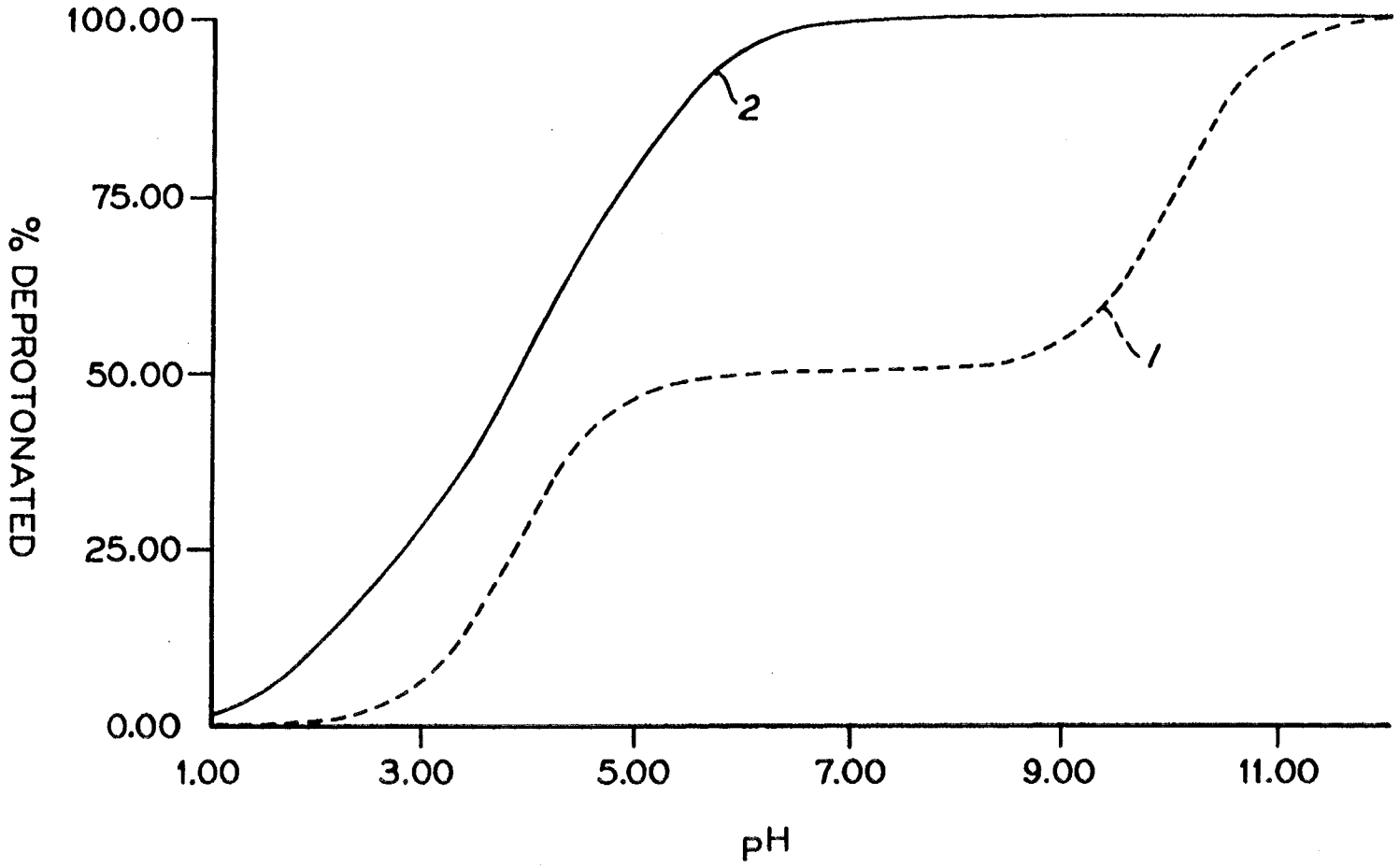
100.00
75.00
50.00
25.00
0.00
% DEPROTONATED
1.00
3.00
5.00
7.00
9.00
11.00
pH
1
2

PROCESS FOR METAL CLEANING

RELATED APPLICATIONS

This application is a continuation-in-part of application Ser. No. 08/092,932 filed Jul. 19, 1993 which is a continuation-in-part of application Ser. No. 07/475,506 filed Feb. 6, 1990.

BACKGROUND OF THE INVENTION

1. Field of the Invention

Our earlier applications as noted above were mainly concerned with the inhibition of corrosion of ferrous metals by certain described compositions which were active for such purpose when fully ionized, generally at an alkaline pH value of at least about 8.9. However, it was also disclosed therein that the same compositions, when at a relatively lower pH, were not only ineffective as corrosion inhibitors, but actually exhibited activity as corrosion agents. The utility of these compositions as metal cleaning agents based upon the mild corrosion ability of polyaspartic acid when at lower pH is now claimed herein.

The present invention relates to new and improved metal cleaning compositions, an unexpected and new use of biodegradable cleaning composition for ferrous metal and to improved processes for cleaning of ferrous metal surfaces susceptible to surface contamination. More particularly, this invention relates to processes for the use of metal cleaning polyamino acids effective to remove corrosion or adherent coating from ferrous metals conveniently and with environmentally friendly compositions.

2. Description of the Related Art

An important mechanism for cleaning metal involves the removal of surface deterioration and deposits and is achieved through the use of uniform corrosion rates. Unfortunately, certain common metal cleaning materials such as strong acids that are used widely as materials for metal cleaning agents have been found to be hazardous to public health and to the surrounding environment. Safe disposal of such hazardous is complicated and expensive. One such example is found in U.S. Pat. No. 3,847,663 to Shumaker. This patent discloses compositions supported by chelating agents such as ethylendiaminetetraacetic acid, trimethylenediaminetetraacetic acid, nitrilotriacetic acid and the like. In U.S. Pat. No. 4,470,920 to Leveskis, there is disclosed an aqueous solution containing nitric acid, sulfamic acid and an amino acid as a chelating agent.

Consequently, it has become desirable to examine the metal cleaning properties of biologically compatible and/or biodegradable compounds. Such compounds, if nontoxic, easy to produce in high purities, and biodegradable, can dramatically ease the chore of removal or recycling. Amino acids have been proposed for limited use. Aspartic acid is known to be inherently corrosive at slightly alkaline pH conditions. See K. Ramakrishnaiah, "Role of Some Biologically Important Compounds on the Corrosion of Mild Steel and Copper in Sodium Chloride Solutions", *Bulletin of Electrochemistry,* 2(1), 7–10 (1986). Therein it was disclosed that aspartic acid at a pH of 8 actually accelerated corrosion. In fact, even when combined with an excellent corrosion inhibitor for mild steel such as papaverine, the presence of aspartic acid maintained the solution's corrosiveness.

The thermal condensation of alpha amino acids to form polymers with loss of water has been known for many years. Early interest in such processes related to theories for formation of prebiotic polypeptides. For the purpose of testing such theories laboratory experiments used powdered L-aspartic acid, usually packed in the bottom of a flask which was then heated below the melting point of the acid. Such reactions were slow and took place over many hours. One such example is reported by Kokufuta et al. in Bulletin of the Chemical Society of Japan Vol. 51 (5) 1555–1556 (1978) "Temperature Effect on the Molecular Weight and the Optical Purity of Anhydropolyaspartic Acid Prepared by Thermal Polycondensation." The structure of anhydropolyaspartic acid has been thoroughly investigated such as by J. Kovacs et al. in J.O.C.S. Vol. 26 1084–1091 (1961).

In recent years many utilities have been suggested for anhydropolyamino acid. Such polyamides have been suggested as potential drug carriers by Neuse et al. in Die Angewandte Makronmolekulare Chemie 192 35–50 (1991) "Water-soluble polyamides as potential drug carriers." They have also been tested as scale inhibitors with respect to natural sea water and calcium sulfate in particular by Sarig et al. as reported by the National Council on Research and Development (NRCD 8–76, Seawater Desalination 150–157 (1977). Polyaspartic acid has been well known for its ability to disperse solid particles in detergent formulations, having been mentioned as a dispersant in numerous patents, a few of which are U.S. Pat. Nos. 4,363,797; 4,333,844; 4,407,722 and 4,428,749. As a departure from the usual manner of utilizing polyaspartic acid in detergent formulations it is reported in Australian Patent A-14775/92 that the polyamide is added to the wash liquor which, upon hydrolysis in situ, is converted into a biodegradable polypeptide builder. Also, as described in U.S. Pat. No. 4,971,724 to Kalota et al., it has been discovered that compositions comprising polyamino acids such as aspartic acid, when ionized at alkaline pH, effectively inhibit corrosion of ferrous metals in the presence of aqueous medium. Various derivatives of polyamino acids have also been made wherein attributes have been supplied by groups attached to reactive sites on the molecule. One such example is disclosed in U.S. Pat. No. 3,846,380 to Fujimoto et al.

Because of the various impending potential utilities of anhydropolyamino acids, interest in processes for preparing such compounds in large volume, particularly polyaspartic acid, has increased. This interest has resulted in several recent patents being issued which are directed to fluid bed systems; in particular, U.S. Pat. No. 5,219,986 to Cassata. Other such patents are U.S. Pat. No. 5,057,597 and 5,221,733 to Koskan and Koskan et al. respectively.

A process for the cleaning of metals of various types by polyamino acids having an additional carboxyl groups (such as polyaspartic acid) under conditions wherein such amino acids are at lower pH would represent a surprisingly unexpected discovery while satisfying a long-felt need for a safe, biodegradable yet effective cleaner in the industry.

SUMMARY OF THE INVENTION

It has been found that certain amino acids, particularly polymers and copolymers of aspartic acid, unexpectedly function effectively as metal cleaning agents for ferrous metals when at relatively low pH under use conditions. Surprisingly, this cleaning effect is accomplished conveniently with many types of ferrous metal surfaces. The ability of the polyamino acid compositions of this invention to clean metal is related to the concentration of the acid in aqueous solution as well as the temperature of the solution. In most instances the relationship between concentration and temperature is inverse. That is, the amount of cleaning ability of a solution is temperature dependent such that lower concentrations are more effective at elevated temperatures.

BRIEF DESCRIPTION OF THE DRAWING

The attached drawing is a graphical comparison of the percent of deprotonation of aspartic acid and polyaspartic acid as a function of the pH of an aqueous solution at room temperature. This relationship aids in the understanding of differences in behavior of these compounds as a function of pH.

DETAILED DESCRIPTION OF THE INVENTION

Useful in the present invention are polyamino acids having multiple carboxyl groups Preferably, these compounds have an excess of carboxyl groups over "free" amino groups. Suitable amino acids are represented by the following formula:

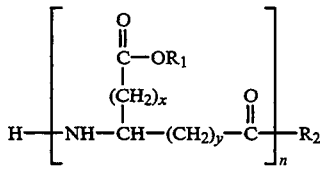

wherein $R_1$ is selected from the group consisting of hydrogen and M wherein M is an alkali metal or alkaline earth metal, $R_2$ is selected from the group consisting of OH and OM, y is an integer from 0 to 2 and x is an integer from 0 to 2 provided that when y is 1 or 2 then x is 0 and when y is 0 then x is 1 or 2 and n is an integer of from about 3 to about 1000.

Illustrative of suitable compounds are polymers of aspartic acid, and copolymers of glutamic and aspartic acid.

These compounds are readily available from a number of sources and can be manufactured either by chemical synthesis or microbial fermentation. See for example, Whitman et al, *Industrial and Engineering Chemistry,* 16(7), 655–670 (1924); and Hurlen et al, *Journal of Electronanalytical Chemistry,* 180, 511–526 (1984).

In the above formula, the polyamino acid or salt may be the homopolymer of aspartic acid, preferably L-aspartic acid, or the result of the polymerization of a mixture of aspartic acid and glutamic acid. Accordingly, each repeating unit is independently selected from an aspartic or glutamic unit. Typically, the mole ratio of aspartic to glutamic acid in the production of copolymers described by the above formula are in the range of from about 1:1 to about 3:1 and usually in the range of from about 1:0.5 to about 3:2. It has been found that when thermally produced the majority of polyaspartic units are of the beta form and a minority of said units are of the gamma form. It is prefered that the polymerization conditions, particularly of the homopolymer of aspartic acid be chosen to provide a maximum of beta form.

In the above formula, typical alkali metals include those of Group I of the Periodic Table of Elements, the most common being sodium, potassium and lithium. The alkaline earth metal referred to in the above formula are those of Group IIa of the Periodic Table of Elements, the most common of which are calcium, magnesium, and barium.

These compounds, while useful as corrosion inhibitors when in the fully ionized state, become metal cleaning agents when at a pH of 7 or below. However it has been found that once they become fully ionized under sufficiently alkaline use conditions, they dramatically reverse the corrosion rate of ferrous metals. In general, the pH values of at least about 2 and up to about 7, depending upon the temperature and the specific compound employed, are suitable as cleaning compositions. Under such use conditions, the removal of surface oxides is increased with increase in temperature. Efficient rates of cleaning action are exhibited by the compositions of this invention when the aqueous cleaning solution is in the range of from 30° C. to about 100° C.

The cleaning agents of the present invention may be employed (in the aqueous medium) at concentrations (by weight) as low as 0.1 percent to as high 35 percent and above. It is particularly preferred to utilize the metal cleaning agents of the present invention at a concentration of from about 1 to about 5 weight percent. It is understood, however, that concentrations greater than 5.0 weight percent of the clean agent can be utilized, if desired, so long as the higher amounts are not detrimental to the system in which the cleaning agents are employed.

Although temperature is known to accelerate the corrosion of metals, it is particularly noted that an increase in temperature alone does not in and of itself improve the cleaning ability of the compositions of the present invention. However, an increase in temperature above room temperature is beneficial in the sense that lower concentrations of the cleaning agent may be employed effectively. Temperatures up to the boiling point of the aqueous solutions may be employed. For example, if the pH of the system is in the range of above about 7, increase in temperature will not provide the compositions of this invention with an ability to provide cleaning of metals. Such a high pH deprives the compositions of this invention of cleaning ability. The pK of the protonated form of the polyamino acid will also decrease with an increase in temperature.

The pH of the aqueous medium under use conditions for the metal cleaning compositions of the present invention may vary from about 2 to about 7, preferably from about 3 to about 5 as measured at ambient or room temperatures (about 25° C.). It is particularly preferred to use the compositions of the present invention at a pH of about 5 or less, as measured at ambient or room temperatures. It is understood, however, as previously noted, that the pH will vary, depending upon the temperature at which it is measured.

The pH of the aqueous medium may be adjusted by addition of any suitable acid or base such as an alkali metal hydroxide, for example, a mineral acid such as sulfuric acid or a base such as sodium hydroxide and potassium hydroxide. Additional acids or bases which my be employed in this invention include hydrochloric acid, phosphoric acid or the like, alkali metal carbonates, hydrocarbylamines, alkaline earth metal hydroxides, and ammonium hydroxides.

It is within the scope of the present invention that the metal cleaning agents may also be used in aqueous media which contain various inorganic and/or organic materials, particularly all ingredients or substances used by the water-treating industry, the automotive industry, and others. Metal cleaning occurs by removal of an external surface layer from the metal. Usually, the surface layer desirably removed is an oxide or sulfide scale or deposit which adheres to the metal with various degrees of tenacity, depending upon the kind of metal and the atmosphere to which the metal has been exposed. Effective removal of the external layer of a metal surface involves mild corrosion of the metal and said corrosion, to be of practical value, must be uniform over the surface as well as mild. Such metal cleaning activity leaves the surface uniformly free of the external coating while providing a relatively smooth external surface of the metal.

Metal cleaning performance is commonly determined by measurement of the rate of corrosion of the surface of the subject metal under specified conditions. The mode of measurement of corrosion rate employed herein may be referred to as the standard metal coupon mass loss test, also referred to as static immersion test. Other standard tests include NACE Sandard TM-01-69 "Laboratory Corrosion Testing of Metals for the Process Industries" or ASTM G-31 "Laboratory Immersion Corrosion Testing of Metals".

In the standard metal coupon mass loss test mode, metal coupons of known mass are immersed in an aqueous solution whose corrosion inhibiting properties are to be determined. The aqueous media is maintained at a specified set of conditions for a specified period of time. At the conclusion of the exposure period, the coupons are removed from the aqueous solution, cleaned in an ultrasonic bath with soap solution, rinsed with deionized water, rinsed with acetone, patted dry with a lint-free paper towel, blown with a stream of nitrogen or air, and weighed to determine mass loss and examined under a stereoscope at suitable magnification to determine penetration of the metal surface due to cleaning action. It should be understood, however, that the detailed expositions of the application of the inventions, while indicating preferred embodiments, are given by way of illustration only and are not to be construed as limiting the invention since various changes and modifications within the spirit of the invention will become apparent to those skilled in the art from this detailed description.

DETAILED DESCRIPTION OF THE DRAWING

In the attached drawing there is shown the percent deprotonation (or protonation, inversely) of polyaspartic acid and the monomer, aspartic acid, through a range of pH levels at room temperature. Curve No. 1 is the results found with L-aspartic acid and curve No. 2 is the results found with polyaspartic acid having a peak molecular weight of about 9200. It can be easily seen that these two compounds differ greatly in the pH range of from 1 to 11. Polyaspartic acid is largely deprotonated after pH 7 while the monomer is less than half deprotonated at said pH. Such behavior helps explain the differences observed in the activity towards metal at various pH levels, not only as between the two compounds, but also with polyaspartic acid itself. Experimental results indicate metal cleaning activity of polyaspartic acid in the pH range of up to about 7.

In the following examples, unless otherwise specified, all parts and percentages are by weight, all temperatures are in degrees Celsius (°C.), pH was measured at 25° C., and "mass loss" is intended to mean "penetration rate".

EXAMPLE 1

Additional tests were conducted to determine the relationship between concentration, temperature and pH of the aqueous metal cleaning solutions of this invention on steel containing a weld portion. Temperature of treatment varied between 35° C. and 93° C. as is noted in Table 3 below. The pH of the individual samples was adjusted with sulfuric acid in those containing polyaspartic acid (peak M.W. 9200) and sodium bisulfate was used to adjust the pH of the blank solutions. The corrosion rate is reported in mpy units and concentration is reported in weight percent. The objective was to determine if, and under what conditions of concentration and temperature, the corrosion is uniform, a necessary attribute of a satisfactory metal cleaning agent. Comments are provided indicating the type of corrosion of the metal coupons after removal from the treating solution and washing.

TABLE 1

| No. | pH | Temp °C. | Wt. % | Corr. Rate (mpy) | Comment |
|---|---|---|---|---|---|
| 1 | 3.5 | 35 | 0 | 2.2 | General corrosion not uniform across surface. |
| 2 | 3.5 | 35 | 1 | 17 | Uniform corrosion. |
| 3 | 3.5 | 35 | 1 | 17 | Uniform corrosion. |
| 4 | 3.5 | 35 | 5 | 30 | General corrosion fairly uniform. |
| 5 | 3.5 | 93 | 0 | 2.3 | Coupon darkened. General attack somewhat localized shallow craters. |
| 6 | 3.5 | 93 | 1 | 44 | Uniform corrosion. |
| 7 | 3.5 | 93 | 1 | 41 | Uniform corrosion. |
| 8 | 3.5 | 93 | 5 | 165 | Severe general attack. |
| 9 | 5.0 | 35 | 0 | 2.3 | General corrosion, not uniform. |
| 10 | 5.0 | 35 | 1 | 4.2 | General corrosion, not uniform. |
| 11 | 5.0 | 35 | 5 | 11 | General corrosion in scattered areas. Some shallow craters. |
| 12 | 5 | 93 | 0 | 2.3 | General corrosion. |
| 13 | 5 | 93 | 1 | 16.0 | Uniform corrosion. |
| 14 | 5 | 93 | 5 | 33 | General corrosion. Many pits. |

EXAMPLE 2

A cleaning test was conducted by immersing 15 mild steel coupons which had received surface tarnish into separate samples of aqueous solutions containing various amounts of metal cleaning agent, polyaspartic acid (peak M.W. 9200). Various temperatures were employed as well as the degree of protonation as indicated by the pH of the test solution. The test conditions and results of the tests are summarized in Table 2 below.

The coupons were tarnished by immersing the coupon in an aqueous solution which would provide an adherent oxide coating on the metal. The solution was prepared by dissolving 234.8 g of 50% sodium hydroxide in 234.4 g of water. Then, 21.38 g of sodium nitrate, 5.08 g of sodium nitrite and 2.54 g of sodium phosphate was added to the boiling solution. The steel coupons were immersed in the boiling solution for 45 minutes. The coupons acquired a black adherent coating on the surface. These treated coupons were then employed in the above described tests.

In the following table 2 the results of the tests are reported. In Table 2 the amount of metal cleaning agent in the test is reported as weight percent and the amount of cleaning is reported as corrosion (Corr.) rate in mils per year (mpy). The color indication relates to the degree of success with respect to cleaning. An indication of "black" color means that cleaning was not successful while "gray" indicates successful cleaning. Of course, the observation of "pit" indicates a lack of uniformity of corrosion. For the purpose of comparison, test Nos. 16 and 17 of Table 2 were run employing L-aspartic acid instead of polyaspartic acid.

TABLE 2

| No | Time Hrs | $Corr_1$ Rate (MPY) | Initial pH | Conc wt % | Temp °C. | Color |
|---|---|---|---|---|---|---|
| 1 | 24.2 | <0.1 | 7 | 3 | 95 | black |
| 2 | 1.0 | 914.7 | 3.5 | 28 | 95 | gray |
| 3 | 24.2 | 48.4 | 5 | 3 | 30 | gray |
| 4 | 24.2 | 50.60 | 3.5 | 28 | 30 | gray |
| 5 | 24.2 | 0.8 | 7 | 28 | 30 | black |
| 6 | 24.2 | 33.9 | 7 | 28 | 95 | gray |
| 7 | 24.2 | 0.5 | 7 | 10 | 30 | black |
| 8 | 24.2 | 59.3 | 3.5 | 10 | 30 | gray |
| 9 | 24.2 | 49.6 | 5 | 10 | 30 | gray |
| 10 | 24.2 | 0.9 | 7 | 3 | 30 | black |
| 11 | 24.2 | 41.7 | 5 | 28 | 30 | gray |
| 12 | 24.2 | 368.4 | 3.5 | 3 | 95 | gray |
| 13 | 24.2 | 54.8 | 3.5 | 3 | 30 | gray |
| 14 | 23.2 | 1.8 | 3.5 | 0 | 95 | black pit |
| 15 | 24.3 | 1044 | 3.5 | 28 | 95 | gray |
| 16 | | 656 | — | 10 | 95 | gray |
| 17 | | 488 | — | 10 | 95 | gray |

The data in Table 2 indicates a strong relationship between temperature and degree of protonation of the polyaspartic acid. This is indicated by a comparison of the results obtained with Coupons Nos. 5 and 6. At the same concentration, an increase in temperature resulted in a dramatic difference in mpy as well as color of the coupon. Other similar comparisons are seen in the data in Table 2.

In Table 2, in test results indicating the color "gray", the coupons exhibited uniform, mild corrosion leaving a relatively smooth, clean metal surface by removal of the external coating on the metal coupon. In those test results indicating the color "black", the coupons were not cleaned since the external coating was not removed in those tests indicating "pits", the coupons contained localized, non-uniform attack of the metal which is not desireable in a cleaning process.

EXAMPLE 3

A copolymer of aspartic and glutamic acids was prepared by combining 336.7 g (2.529 moles) of L-aspartic acid with 250.2 g (1.7 moles) of glutamic acid The mixture was placed into a dish and reacted for 4.5 hours at a temperature of 230° C. in a forced draft oven. The product solidified weighing 421.1 g (97% of theoretical). The copolymer was hydrolyzed by adding 305 g of product to 1357 g of water and 121.5 g of sodium hydroxide. Six solutions were prepared by adjusting the pH of each separate solution with either sodium hydroxide or sulfuric acid. The concentration of each solution was varied as indicated below in Table 4.

Carbon steel coupons were oxidized by first preparing a solution as follows, wherein amounts are in grams:

| Ingredient | Amount |
|---|---|
| sodium hydroxide | 93.2 |
| sodium nitrate | 17.1 |
| sodium nitrite | 4.1 |
| sodium phosphate, | 3.3 (dibasic, heptahydrate) |
| water | 270.3 |

The metal coupons were washed with soap and water, rinsed with acetone and dried. Immediately after drying, the coupons were immersed in the above described solution, which had been brought to a boil, for 45 minutes. After removal from the solution the coupons bearing a coating of iron oxide were rinsed with water and acetone. Two hundred gram portions of the test solutions as described in Table 3 below were placed into 8 jars and the rinsed, metal coupons immersed therein for 24 hours. The solutions containing the metal coupons were held at varying temperatures and different pH levels. After removal, the metal coupons were rinsed with water, scrubbed with a soft brush, rinsed with water and acetone, dried and evaluated. The results of the tests are summarized below in Table 3 wherein the concentration of the copolymer is given in weight percent, the temperature in °C. and the corrosion rate (corr. rate) given in mils/yr.

TABLE 3

| Coupon No | pH | wt % | Temp. | Corr Rate | Comment |
|---|---|---|---|---|---|
| 1 | 5 | 10 | 95 | 167 | dull gray |
| 2 | 7 | 10 | 95 | 33 | drk gray |
| 3 | 3.5 | 10 | 35 | 62 | gray* |
| 4 | 3.5 | 3 | 35 | 65 | dull gray |
| 5 | 5 | 10 | 35 | 44 | dull gray |
| 6 | 5 | 3 | 35 | 43 | dull gray |
| 7 | 7 | 10 | 35 | 11 | bright |
| 8 | 7 | 3 | 35 | 8 | bright |
| 9 | 3.5 | 3 | 95 | 469 | dull gray |
| 10 | 5 | 3 | 95 | 99 | dull gray |
| 11 | 7 | 3 | 95 | 24 | shiny |
| 12 | 5 | 10 | 60 | 106 | dull gray |
| 13 | 5 | 3 | 60 | 73 | dull gray |

*some black dots

From the above Table 4 it can be seen that all solutions cleaned the oxide coating from the metal coupons under the conditions shown in said Table.

What is claimed is:

1. A method for cleaning the surface of ferrous metals containing ferrous metal compounds which comprises contacting said surface at a pH of about 7 or below with an effective amount of an aqueous cleaning composition comprising:

(a) a polyamino acid represented by the formula

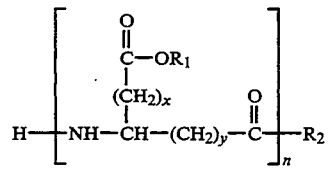

wherein $R_1$ is selected from the group consisting of hydrogen and M wherein M is an alkali metal or alkaline earth metal, $R_2$ is selected from the group consisting of OH and OM, y is an integer from 0 to 2 and x is an integer from 0 to 2 provided that when y is 1 or 2 then x is 0 and when y is 0 then x is 1 or 2 and n is an integer of from about 3 to about 1000 whereby the metal surface is uniformly and mildly corroded to remove said ferrous metal compounds.

2. The method of claim 1 wherein the amino acid groups are selected from the group consisting of aspartic acid, and glutamic acid and salts thereof.

3. The method of claim 1 wherein the amino acid groups are aspartic acid and salts thereof.

4. The method of claim 1 wherein the polyamino acid is present in an amount sufficient to provide a polyamino acid concentration in the aqueous medium under use conditions of from about 1 to about 35 weight percent and higher.

5. The method of claim 4 wherein the polyamino acid is present in an amount sufficient to provide a polyamino acid concentration in the aqueous medium under use conditions of from about 3 to about 30 weight percent.

6. The method of claim 1 wherein the pH in the aqueous medium under use conditions is from about 3.5 to about 5.

7. The method of claim 1 wherein the aqueous medium is under substantially static conditions.

8. The method of claim 1 wherein the aqueous medium is under dynamic fluid conditions.

9. The method of claim 1 wherein M is an alkali metal.

10. The method of claim 9 wherein the alkali metal is sodium.

11. The method of claim 1 wherein M is an alkaline earth metal.

12. The method of claim 11 wherein the alkaline earth metal is calcium.

* * * * *